US008120573B2

(12) United States Patent
Chiou et al.

(10) Patent No.: US 8,120,573 B2
(45) Date of Patent: Feb. 21, 2012

(54) COLOR SEQUENTIAL TIMING CONTROLLING CIRCUIT AND BOTH COLOR SEQUENTIAL DISPLAY SYSTEM AND METHOD THEREOF

(75) Inventors: Shian-Jun Chiou, Taipei (TW); Wen-Chih Tai, Hsinchu County (TW); Hun-Wei Chen, Taoyuan County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 290 days.

(21) Appl. No.: 12/689,234

(22) Filed: Jan. 19, 2010

(65) Prior Publication Data

US 2011/0063525 A1 Mar. 17, 2011

(30) Foreign Application Priority Data

Sep. 14, 2009 (TW) ..... 98130949 A

(51) Int. Cl.
*G09G 3/36* (2006.01)

(52) U.S. Cl. ..... 345/103; 345/694

(58) Field of Classification Search ..... 345/100, 345/98, 545, 530, 103, 88, 694
See application file for complete search history.

(56) References Cited

U.S. PATENT DOCUMENTS

2002/0158823 A1* 10/2002 Zavracky et al. ..... 345/87
2006/0143454 A1* 6/2006 Walmsley ..... 713/170
2007/0018919 A1* 1/2007 Zavracky et al. ..... 345/87
2007/0083491 A1* 4/2007 Walmsley et al. ..... 707/3

* cited by examiner

*Primary Examiner* — Ricardo L Osorio
(74) *Attorney, Agent, or Firm* — Winston Hsu; Scott Margo

(57) ABSTRACT

In a line data sorting unit of a color sequential timing controlling circuit, inputted pixels/sub-pixels are buffered, sorted, and outputted. The pixels/sub-pixels are also sorted by a color data sorting unit according to the color sequential method and colors of sub-pixels so that a driving controller writes sorted sub-pixels of various colors onto a display panel within a short time variation to generate a full-color frame. The line data sorting unit buffers pixels/sub-pixels as a matrix, and loads the buffered pixels/sub-pixels line-by-line with respect to the matrix, where the pixels/sub-pixels are arranged and read in parallel according to sizes of lines of the matrix and a number of simultaneously-activated gate lines of a scanning driver.

34 Claims, 12 Drawing Sheets

COLOR SEQUENTIAL TIMING CONTROLLING CIRCUIT AND BOTH COLOR SEQUENTIAL DISPLAY SYSTEM AND METHOD THEREOF

BACKGROUND OF THE INVENTION

1. Field of the Invention

The present invention discloses a color sequential timing controlling circuit and both a color sequential display and a method thereof, and more particularly, to a color sequential timing controlling circuit of activating multi-gate lines in cooperation with data arrangement for loading data and both a color sequential and a method thereof.

2. Description of the Prior Art

A color sequential timing controlling circuit is usually equipped on a display applying the color sequential method, for displaying sub-pixels of each of a plurality of pixels on a single full-color frame on a display panel of the display, within an extremely-short time interval in an overlapped manner, so as to take advantages of visual residue in displaying all pixels on the full-color frame.

Please refer to FIG. 1, which is a diagram of a conventional color sequential display 100. As shown in FIG. 1, the color sequential display 100 includes a color sequential timing controlling circuit 110, a data driving unit 120, a scan driving unit 130, a display panel 140, a light emitting diode driving unit 150, a backlight module 160, and two buffers 108 and 112. The display panel 140 determines displayed pixels corresponding to its transistors according to scan lines driven by the scan driving unit 130 and data lines driven by the data driving unit 120. For implementing the color sequential method, the color sequential timing controlling circuit 110 is used for controlling timings of the data driving unit 120 and the scan driving unit 130, so as to load sub-pixels of different colors into the display panel 140 within non-overlapped and extremely-short time intervals. The color sequential timing controlling circuit 100 also controls timings of the light emitting diode driving unit 150 to determine a timing of activating the backlight module 160.

The color sequential timing controlling circuit 110 includes an input buffer 102, an image sorting unit 104, and a drive controlling circuit 106. The input buffer 102 is used for synchronizing a synchronous signal dei, which is inputted from external of the color sequential timing controlling circuit 110, a pixel clock pclk, a plurality of pixels, and a system clock sclk used by the color sequential timing controlling circuit 110. The image sorting unit 104 cooperates with the buffers 108 and 112, so as to output a pixel of a single frame by cooperating with the scan driving unit 130, which merely activates a unique gate line at a time. Sub-pixels within pixels of the frame are also classified according to respective colors, so as to load red sub-pixels, indicated as a capital R on FIG. 1, green sub-pixels, indicated as a capital G on FIG. 1, and blue sub-pixels, indicated as a capital B on FIG. 1, of the frame within non-overlapped and extremely-short time variations with the aid of the buffers 108 and 112, and so as to have the driving controlling unit 106 indirectly control the displaying of the full-color frame on the display panel 140.

For improving data transmission efficiency of the color sequential display 100 shown in FIG. 1, the scan driving unit 130 may be configured to simultaneously activate at least two gate lines. However, as a result, a transmission order between the simultaneously activated gate lines may fail in disorder, and pixels may not be restored correctly after being transmitted, so that the display panel 140 cannot display pixels on the frame correctly as well.

SUMMARY OF THE INVENTION

The claimed invention discloses a plurality of color sequential timing controlling circuits, related color sequential display systems, and an image data sorting and loading method thereof, so as to achieve a high transmission rate by activating multiple gate lines simultaneously without losing a correct pixel processing order.

The claimed invention discloses a color sequential timing controlling circuit, which is applied on a color sequential display and of activating multi-gate lines in cooperation with data arrangement for loading data. The color sequential timing controlling circuit includes a line data sorting unit. The line data sorting unit is used for buffering and loading a plurality of pixels. The line data sorting unit includes a line buffer and an insertion sorting circuit. The line buffer is used for buffering the plurality of pixels in a matrix form. The insertion sorting circuit is used for segmenting the plurality of pixels buffered by the line buffer into a plurality of first equal partitions according to a first segment divisor, so as to simultaneously load pixels of each of the plurality of first equal partitions. The line buffer is also used for segmenting each of the first equal partitions into a plurality of second equal partitions according to a second segment divisor, so as to loads pixels in each of the second equal partitions according to a pixel loading sequence. The color data sorting unit is used for classifying and sorting sub-pixels of the plurality of pixels loaded and buffered by the line data sorting unit, according to colors of the sub-pixels. The color sequential timing controlling circuit outputs the sub-pixels sorted by the color data sorting unit according to a time variation, so as to generate a full-color frame. The pixel loading sequence indicates simultaneously loading a pixel from each of a plurality of third equal partitions segmented from the second equal partition, and a number of the plurality of third equal partitions in the second equal partition is corresponding to a number of simultaneously activated gate lines of a scan driving unit of the color sequential display.

The claimed invention discloses a color sequential display system. The color sequential display system includes a line data sorting unit. The line data sorting unit is included by a mainframe terminal of the color sequential display system, for buffering and loading a plurality of pixels. The line data sorting unit includes a line buffer, an insertion sorting circuit, and a color data sorting unit. The line buffer is used for buffering the plurality of pixels. The insertion sorting circuit is used for segmenting the plurality of pixels buffered by the line buffer into a plurality of first equal partitions, for simultaneously loading arranged-in-matrix pixels of each of the plurality of first equal partitions. The insertion sorting circuit is also used for segmenting a plurality of pixels of each of the plurality of first equal partitions into a plurality of second equal partitions according to a second segment divisor, for loading pixels from each of the plurality of second equal partitions according to a pixel loading sequence. The color data sorting unit is included by a color sequential display of the color sequential display system, for classifying and sorting sub-pixels of each of the plurality of pixels, according to colors of the sub-pixels buffered and loaded by the line data sorting unit. The color sequential display outputs the sub-pixels of different colors classified by the color data sorting unit according to a time variation, so as to generate a full-color frame. The pixel loading sequence indicates simultaneously loading a pixel of each of a plurality of third equal partitions included by the second equal partition, and a number of the plurality of third equal partitions is corresponding to a number of simultaneously activated gate lines of a scan driving unit of the color sequential display.

The claimed invention discloses a color sequential timing controlling circuit, which is applied on a color sequential display and is of activating multi-gate lines in cooperation with data arrangement for loading data. The color sequential timing controlling circuit includes a color data sorting unit and a line data sorting unit. The color data sorting unit is used for classifying and sorting sub-pixels of a plurality of pixels into a plurality of sub-pixel groups, each of which corresponds to different colors, according to colors of the sub-pixels. The line data sorting unit is used for buffering and loading the plurality of sub-pixel groups from the color data sorting unit. The line data sorting unit includes a line buffer and an insertion sorting circuit. The line buffer is used for buffering one of the plurality of sub-pixel groups. The insertion sorting circuit is used for segmenting a plurality of sub-pixels included by the sub-pixel group buffered by the line buffer into a plurality of first equal partitions, according to a first segment divisor, so as to simultaneously load arranged-in-matrix sub-pixels of each of the plurality of first equal partitions. The insertion sorting circuit is also used for segmenting a plurality of sub-pixels of each of the plurality of first equal partitions into a plurality of second equal partitions according to a second segment divisor, so as to load sub-pixels of each of the second equal partitions according to a sub-pixel loading sequence. The color sequential display outputs a plurality of sub-pixel groups of different colors loaded by the line data sorting unit according to a time variation, for generating a full-color frame. The sub-pixel loading sequence indicates simultaneously loading a sub-pixel of each of the plurality of third equal partitions, and a number of the plurality of third equal partitions corresponds to a number of simultaneously activated gate lines of a scan driving unit included by the color sequential display.

The claimed invention discloses a color sequential timing controlling circuit, which is applied on a color sequential display and of activating multi-gate lines in cooperation with data arrangement for loading data. The color sequential timing controlling circuit includes a line buffer and an insertion sorting circuit. The line buffer is used for buffering one of the plurality of sub-pixel groups of different colors. The insertion sorting circuit is used for segmenting a plurality of sub-pixels included by the sub-pixel group buffered by the line buffer into a plurality of first equal partition according to a first segment divisor, for simultaneously loading arranged-in-matrix sub-pixels of the plurality of first equal partitions. The insertion sorting circuit is also used for segmenting a plurality of sub-pixels included by each of the plurality of first equal partitions into a plurality of second equal partitions, so as to load sub-pixels in each of the plurality of second equal partitions according to a sub-pixel loading sequence. The color sequence timing controller shares a video board and a buffer of the video board with a mainframe terminal, and the plurality of sub-pixel groups are generated by classifying and sorting sub-pixels of a plurality of pixels by the video board and the buffer. The color sequential display outputs a plurality of sub-pixel groups of different colors loaded by the line data sorting unit according to a time variation, so as to generate a full-color frame. The sub-pixel loading sequence indicates simultaneously loading a sub-pixel from each of a plurality of third equal partitions included by the second equal partition, and a number of the plurality of third equal partitions in the second equal partition is corresponding to a number of simultaneously activated gate lines of a scan driving unit of the color sequential display.

The claimed invention discloses a color sequential timing controlling circuit, applied on a color sequential display and of activating multi-gate lines in cooperation with data arrangement for loading data. The color sequential timing controlling circuit includes a hybrid line data sorting unit. The hybrid line data sorting unit is used for buffering a plurality of pixels, and for loading the plurality of pixels in forms of sub-pixels. The hybrid line data sorting unit includes a color data sorting unit, a line buffer, and an insertion circuit. The color data sorting unit is used for classifying and sorting sub-pixels of each of the plurality of pixels into a plurality of sub-pixel groups, according to colors of the sub-pixels of each of the plurality of pixels. Each of the plurality of sub-pixel groups is corresponding to a unique color. The line buffer is used for buffering the plurality of sub-pixel groups in forms of matrixes. The insertion circuit is used for segmenting a plurality of sub-pixels included by one of the plurality of sub-pixel groups into a plurality of first equal partitions, according to a first segment divisor, so as to simultaneously load arranged-in-matrix sub-pixels of each of the plurality of first equal partitions. The insertion circuit is also used for segmenting a plurality of sub-pixels of each of the plurality of first equal partitions, according to a second segment divisor, so as to load sub-pixels in each of the plurality of second equal partitions according to a sub-pixel loading sequence. The color sequential timing controlling circuit outputs a plurality of sub-pixel groups of different colors sorted by the color data sorting unit according to a time variation, so as to generate a full-color frame. The sub-pixel loading sequence indicates simultaneously loading a sub-pixel from each of the plurality of third equal partitions included by the second equal partition, and a number of the plurality of third equal partitions is corresponding to a number of simultaneously activated gate lines of a scan driving unit included by the color sequential display.

The claimed invention discloses an image data sorting and loading method of loading data by activating multi-gate lines in cooperation with data arrangement on a color sequential display. The method includes segmenting a plurality of pixel elements buffered in a line buffer of a color sequential display into a plurality of first equal partitions according to a first segment divisor, so as to simultaneously load pixel elements of each of the plurality of first equal partitions; and segmenting a plurality of pixel elements of each of the plurality of first equal partitions into a plurality of second equal partitions according to a second segment divisor, so as to simultaneously load a pixel element from each of a plurality of third equal partitions within the second equal partition. The pixel elements of each of the plurality of first equal partitions are arranged on the line buffer as a matrix. A number of the plurality of third equal partitions included by the second equal partition is corresponding to a number of simultaneously activated gate lines of a scan driving unit included by the color sequential display.

The claimed invention discloses a color sequential display system of loading data by activating multi-gate lines in cooperation with data arrangement. The color sequential display system includes a mainframe terminal and a color sequential display. The mainframe terminal includes a video board, a line data sorting unit, and a buffer. The video board includes a color sequential data sorting unit, which is used for classifying and sorting sub-pixels of each of a plurality of pixels, according to colors of the sub-pixels. The line data sorting unit is used for buffering and loading the plurality of pixels classified and sorted by the color data sorting unit. The line data sorting unit includes a line buffer and an insertion sorting circuit. The line buffer is used for buffering the plurality of pixels. The insertion sorting circuit is used for segmenting the plurality of pixels buffered by the line buffer into a plurality of first equal partitions according to a first segment divisor, so as to simultaneously load arranged-in-matrix pixels of each of the plurality of first equal partitions. The line buffer is also used for segmenting a plurality of pixels of each of the plurality of first equal partitions into a plurality of second equal partitions according to a second segment divisor, so as to load pixels from each of the plurality of second equal partitions according to a pixel loading sequence. The buffer is for serving as a buffering unit while classifying and sorting the plurality of pixels by the color data sorting unit and the line data sorting unit. The color sequential display includes an input buffer and a drive controlling unit. The input buffer is used for receiving the plurality of pixels buffered and loaded by the line data sorting unit, and for synchronizing a synchronous signal, which is inputted from external of the color sequential display, a pixel clock, the plurality of pixels, and a system clock used by the color sequential display. The drive controlling unit is used for controlling timings of a data driving unit, a scan driving unit, and a light emitting diode included by the color sequential display, according to the synchronous signal and the system clock. The drive controlling unit is also used for controlling the data driving unit and the scan driving unit to display a generated full-color frame on a display panel of the color sequential display, according to the sub-pixels of different colors outputted by the color sequential timing controlling circuit. The color sequential display is used for outputting a plurality of sub-pixels of different colors classified and sorted by the color data sorting unit according to a time variation, so as to generate the full-color frame. The pixel loading sequence indicates simultaneously loading a pixel of each of the plurality of third equal partitions included by the second equal partition, and a number of the plurality of third equal partitions corresponds to a number of simultaneously activated gate lines of a scan driving unit included by the color sequential display. The color sequential display shares the video board and the buffer with the mainframe terminal.

These and other objectives of the present invention will no doubt become obvious to those of ordinary skill in the art after reading the following detailed description of the preferred embodiment that is illustrated in the various figures and drawings.

DETAILED DESCRIPTION

For further improving performance of the conventional color sequential display as mentioned above, the present invention discloses a color sequential timing controlling circuit of loading data by activating multiple gate lines in cooperation with data arrangement and of being applied on a color sequential display, and both a color sequential display and data loading method thereof. In the disclosed color sequential timing controlling circuit of the present invention, an improved pixel sorting and loading technique is primarily characterized for processing pixels by simultaneously activating multiple gate lines, so as to have pixels be loaded correctly without suffering from overlapped loading errors on a full-color frame displayed by the conventional color sequential display, which activates multiple gates at a same time.

Figure 1:
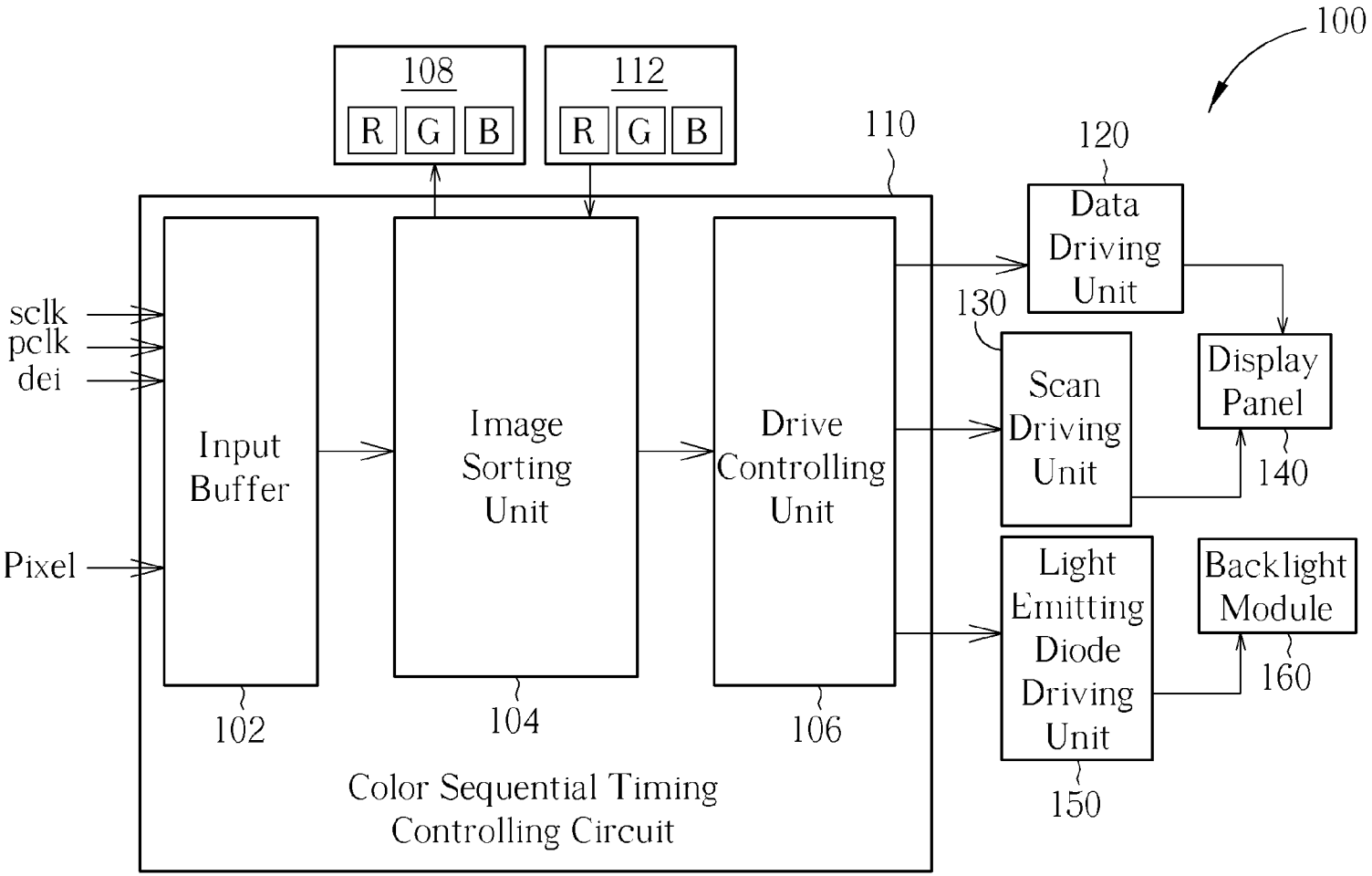
FIG. 1 is a diagram of a conventional color sequential display.
Figure 2:
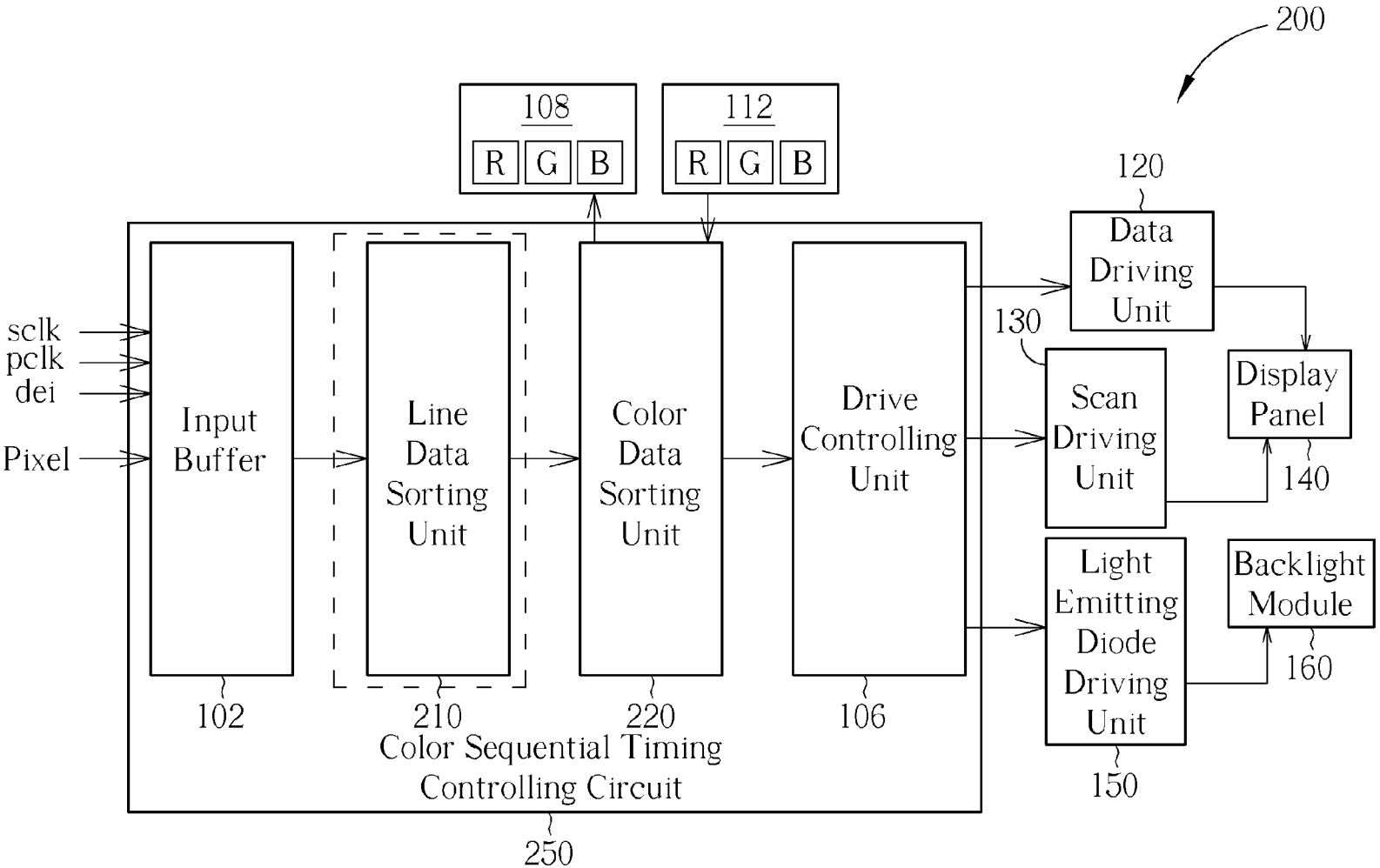
FIG. 2 illustrates a color sequential display according to a first embodiment of the present invention.

Please refer to FIG. 2, which illustrates a color sequential display 200 according to a first embodiment of the present invention. As shown in FIG. 2, the color sequential display 200 includes most elements of the color sequential display 100 shown in FIG. 1, however, the image sorting unit 104 shown in FIG. 1 is replaced by a line data sorting unit 210 and a color data sorting unit 220, and the color sequential timing controlling circuit 110 shown in FIG. 1 is replaced by a color sequential timing controlling circuit 250 accordingly. The line data sorting unit 210 is primarily used for buffering and loading a plurality of pixels received by the input buffer 102. The color data sorting unit 220 is used for classifying and sorting sub-pixels of the plurality of pixels buffered and loaded by the line data sorting unit, according to colors of the sub-pixels. With the aid of the buffers 108 and 112, the color sequential timing controlling circuit 250 is capable of outputting sub-pixels of different colors sorted by the color data sorting unit 220 with an extremely-short time variation, and of generating a full-color frame accordingly.

Figure 3:
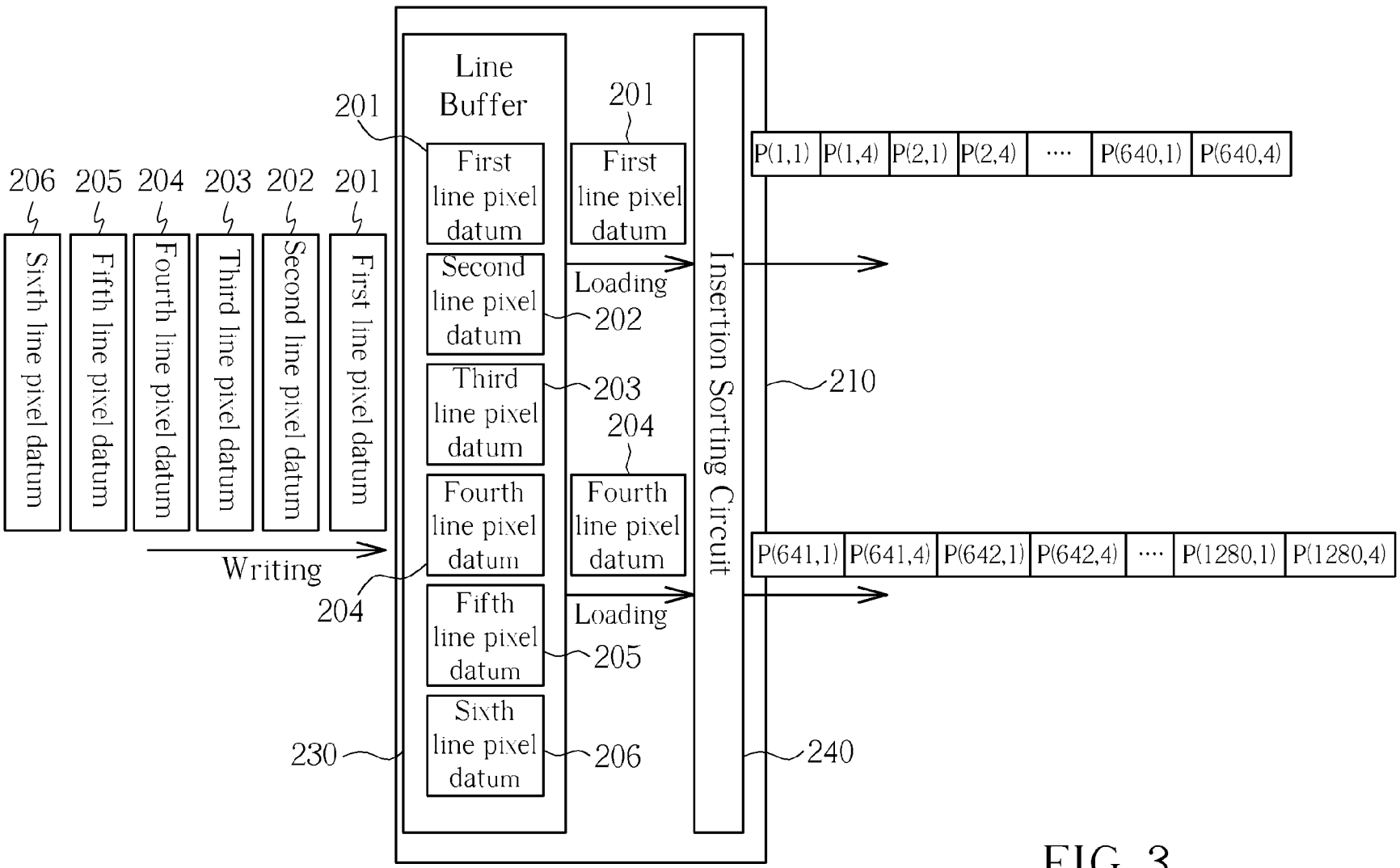
FIG. 3 illustrates the line data sorting unit shown in FIG. 2.
Figure 4:
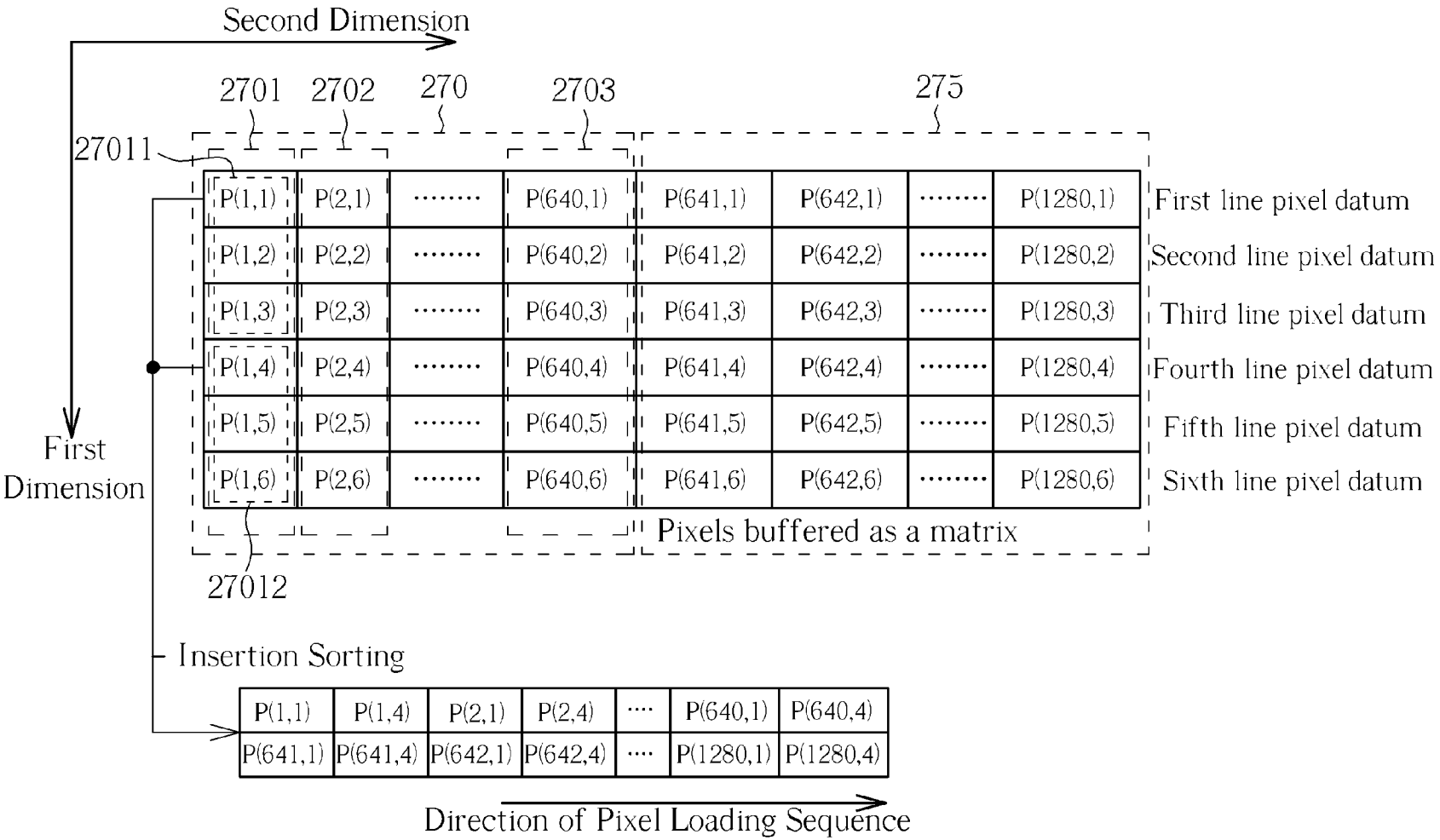
FIG. 4 illustrates the pixel arrangement of the line buffer and the insertion sorting circuit shown in FIG. 3 by representing the pixel arrangement in a matrix form.

Detail structure and pixel arrangement of the line data sorting unit 210 is disclosed in FIG. 3 and FIG. 4. Please refer to FIG. 3, which illustrates the line data sorting unit 210 shown in FIG. 2. As shown in FIG. 3, the line data sorting unit 210 includes a line buffer 230 and an insertion sorting circuit 240. The line buffer 230 is used for buffering a plurality of pixels transmitted from the input buffer 102 in a matrix form. The insertion sorting circuit 240 is used for arranging the pixels buffered by the line buffer 230 and for loading the arranged pixels into the color data sorting unit 220. The pixel arrangement of the line buffer 230 and the insertion sorting circuit 240 is disclosed in FIG. 4, which represents the pixel arrangement in a matrix form.

Please refer to FIG. 3 and FIG. 4 together. Pixels are loaded from the input buffer 102 to the line buffer 230 line by line, i.e., six line pixel data from the first line pixel datum 201 to the sixth line pixel datum 206 shown in FIG. 3, where each of the line pixel data may include a plurality of pixels, and the loaded line pixel data are then arranged as shown in FIG. 4. Note that the line data sorting unit 210 is not limited to load six line pixel data at a time as shown in FIG. 3, the line data sorting unit 210 may also load other numbers of line pixel data at a time in other embodiments of the present invention.

Besides, after the line buffer 230 is fully loaded by pixels from the line data sorting unit 210, i.e., when six line pixel data of a same line shown in FIG. 3 are all loaded, all line pixel data buffered by the line buffer 230 may be sorted immediately. In FIG. 4, all pixels loaded into the line buffer 230 are given with a serial. For example, the first line pixel datum shown in FIG. 3 includes pixels P(1,1), P(2,1), P(3,1), . . . , P(1280,1), the second line pixel datum 202 shown in FIG. 3 includes pixels P(1,2), P(2,2), P(3,2), . . . , P(1280,2), the third line pixel datum 203 shown in FIG. 3 includes pixels P(1,3), P(2,3) (3,3), . . . , P(1280,3), . . . , and the sixth line pixel datum 206 shown in FIG. 3 includes pixels P(1,6), P(2,6), P(3,6), . . . , P(1280,6), where the third, fourth, fifth line pixel data 203, 204, 205 also includes corresponding pixels on FIG. 4 as inducted.

As shown in FIG. 4, pixels of from the first line pixel datum 201 to the sixth line pixel datum 206 are segmented into two first equal partitions 270 and 275, and pixels of both the equal partitions 270 and 275 are outputted simultaneously, i.e., outputted in parallel. For example, the pixels P(1,1) and P(641,1) are outputted at a same time, and the pixels P(1,4) and P(641,4) are outputted at a same time as well, as shown in FIG. 3. Note that while pixels are segmented into two first equal partitions, 2 is regarded as a value of a first segment divisor, where a number of all pixels buffered in the line buffer 230 has to be divisible by the first segment number. For example, there are 1,280*6=7,680 pixels buffered in the line buffer 230 as shown in FIG. 4, and the number 7,680 is divisible by the current value 2 of the first segment divisor.

Focus on the first equal partition 270. For implementing the simultaneous loading on each of the first equal partitions, each of the plurality of the first equal partitions has to be segmented into a plurality of second equal partitions, according to a second segment divisor, for example, the second partitions 2701, 2702, 2703 shown in FIG. 4. The second partition 2701 includes pixels P(1,1), P(1,2), P(1,3), P(1,4), P(1,5), P(1,6); the second partition 2702 includes pixels P(2,1), P(2,2), P(2,3), P(2,4), P(2,5), P(2,6); and the third partition 2703 includes pixels P(640,1), P(640,2), P(640,3), P(640,4), P(640,5), P(640,6). As can be observed from FIG. 3 and FIG. 4, the first partition 270 is segmented into a plurality of second partitions according to a second segment divisor having a value 6, moreover, as can be observed from the second partitions 2701, 2702, and 2703, each of the second partitions includes one pixel of each of the line pixel data 201-206. Note that the second segment divisor is merely required to be a divisor for a number of pixels of the first equal partition. For example, as shown in FIG. 4, a number of all pixels within the first equal partition 270 equals to 640*6=3,840, which is divisible by 6, i.e., a current value of the second segment divisor.

Focus on the second partition 2701. Besides simultaneously loading each of the first equal partitions, the plurality of second equal partitions are to be loaded by following a pixel loading sequence in units of a single second equal partition. Therefore, each of the plurality of second partitions is segmented into a plurality of third equal partitions. The pixel loading sequence indicates loading one pixel from each of the third equal partitions within the second partition 2701. Note that a number of the plurality of third equal partitions within the second partition 2701 is corresponding to a number of simultaneously activated gate lines of the scan driving unit 130. As can be observed from FIG. 4, while the scan driving unit 130 is set to activate two gate lines simultaneously, there will be two third equal partitions in a single second equal partition, so that the second equal partition 2701 includes two third equal partitions 27011 and 27012, where the third equal partition 27011 includes pixels P(1,1), P(1,2), and P(1,3), and the third equal partition includes pixels P(1,4), P(1,5), and P(1,6).

In FIG. 4, pixels of each line pixel datum is stored in the line buffer 230 so as to form a two-dimensional matrix. For example, as can be observed in FIG. 4, a first dimension on the matrix indicates a direction from the pixel P(1,1) to the pixel P(1,6), and a second dimension on the matrix indicates a direction from the pixel P(1,1) to the pixel P(1280,1). Therefore, pixels of each of the second equal partitions are aligned on a first dimensional line along the first dimension on the line buffer, whereas each of the second equal partitions is aligned along the second dimension. As a result, a size of the first dimensional line equals a number of pixels included by each of the second equal partitions, and a size of the second dimensional line equals a total number of the plurality of second equal partitions on the line buffer 230. Note that both the first and second dimensions are merely used for explaining the concept of buffering pixels in rows or columns in FIG. 4.

While the insertion sorting circuit 240 outputs pixels, the insertion sorting circuit 240 loads one-by-one line pixel data having a number equal to the amount of the simultaneously-activated gate lines, i.e., the number of the third equal partitions in a single second equal partition. For example, in the first equal partition 270 shown in FIG. 4, as an order, the pixel P(1,1) is loaded in the third equal partition 27011 of the second equal partition 2701, the pixel P(1,4) of the third equal partition 27012 is loaded in the second equal partition 2701, and then the pixels P(2,1), P(2,4), P(3,1), P(3,4), . . . , P(640,1), P(640,4) are loaded in order; at the same time, in the first equal partition 275, the pixels P(641,1), P(641,4), P(642,1), P(642,4), . . . , P(1280,1), P(1280,4) are also loaded in order; and as a result, pixels of the first line pixel datum 201 and within the first equal partition 270, and pixels of the fourth line pixel datum 204 and within the second equal partition 275, are loaded in parallel, as indicated by the pixel loading sequence shown in FIG. 4 or FIG. 3. Then the second line pixel datum 202 and the fifth line pixel datum 205 are loaded simultaneously, and the third line pixel datum 203 and the sixth line pixel datum 206 are also loaded simultaneously; in other words, the insertion sorting circuit 240 loads pixels from the second and fifth line pixel data 202 and 205 according to the pixel loading sequences [P(1,2), P(1,5), P(2,2), P(2,5), . . . , P(640,2), P(640,5)] and [P(641,2) P(641,5), P(642,2), P(642,5), . . . , P(1280,2), P(1280,5)], and then loads the third and sixth line pixel data 203 and 206 by following the pixel loading sequences [P(1,3), P(1,6), P(2,3), P(2,6), . . . , P(640,3), P(640,6)] and [P(641,3), P(641,6), P(642,3), P(642,6), . . . , P(1280,3), P(1280,6)]. Note that merely the pixel loading sequences for both the first line pixel datum 201 included by the first equal partition 270 and the fourth line pixel datum 204 included by the second equal partition 275 shown on FIG. 3 and FIG. 4 for brevity, and the pixel loading sequences of other line pixel data of the first equal partitions 270 and 275 maybe obviously inducted according to the above descriptions.

Note that the first segment divisor, the second divisor, the number of simultaneously-activated gate lines for determining a number of third equal partitions in a single second equal partition, a number of pixels buffered by the line buffer, which may be determined according to sizes of both the first and second dimensional lines, a number of line pixel data loaded by the line buffer at a time, and the pixel loading sequence followed in loading each of the third equal partition, are all variables according to a preferred embodiment of the present invention. It indicates the fact that the variables may indicate different values in other embodiments of the present invention as long as respective requirements are fulfilled, and the fact that embodiments generated by alternating values of the above-mentioned variables should also be regarded as embodiments of the present invention.

Note that even if the number of simultaneously-activated gate lines of the scan driving unit is one, the pixel sequence on the first equal partition 270 may still be [P(1,1), P(2,1), . . . , P(640,1), P(1,2), P(2,2), . . . , P(640,2), . . . , P(640,6)] so as to precisely load the first equal partition 270 line-by-line. In other words, even if the number of simultaneously-activated gate lines of the scan driving unit is reduced to one, operations shown in FIG. 4 are still maintained normally, as indicated as one embodiment of the present invention.

Please refer to FIG. 2 again. After the line data sorting unit 210 sorts pixels by means shown in FIG. 3 and FIG. 4 and outputs the pixels to the color data sorting unit 220, the color data sorting unit 220 segments each of received pixels into a plurality of sub-pixels, and buffers the sub-pixels in one of the buffers 108 and 112 according to types of the sub-pixels. For example, a red sub-pixel, a green sub-pixel, and a blue pixel of a same pixel may be respectively buffered in the blocks R,G,B shown in the buffer 108 or 112, by following an order of outputting pixels by the line data sorting unit 210. Later, the color data sorting unit 220 also loads sub-pixels of different colors from one of the buffers 108 and 112 into the drive controlling unit 106, by following the order of buffering the sub-pixels to the corresponding buffer 108 or 112, so as to display the full-color frame on the display panel 140 according to the color sequential method. Note that when one of the buffers 108 and 112 is written with a first group of sub-pixels, the other one is loaded with a second group of sub-pixels at the same time. In other embodiments of the present invention, the color data sorting unit 220 also cooperates with at least one buffer to load or write sub-pixels, without being limited to two buffers 108 and 112 shown in FIG. 2.

Figure 5:
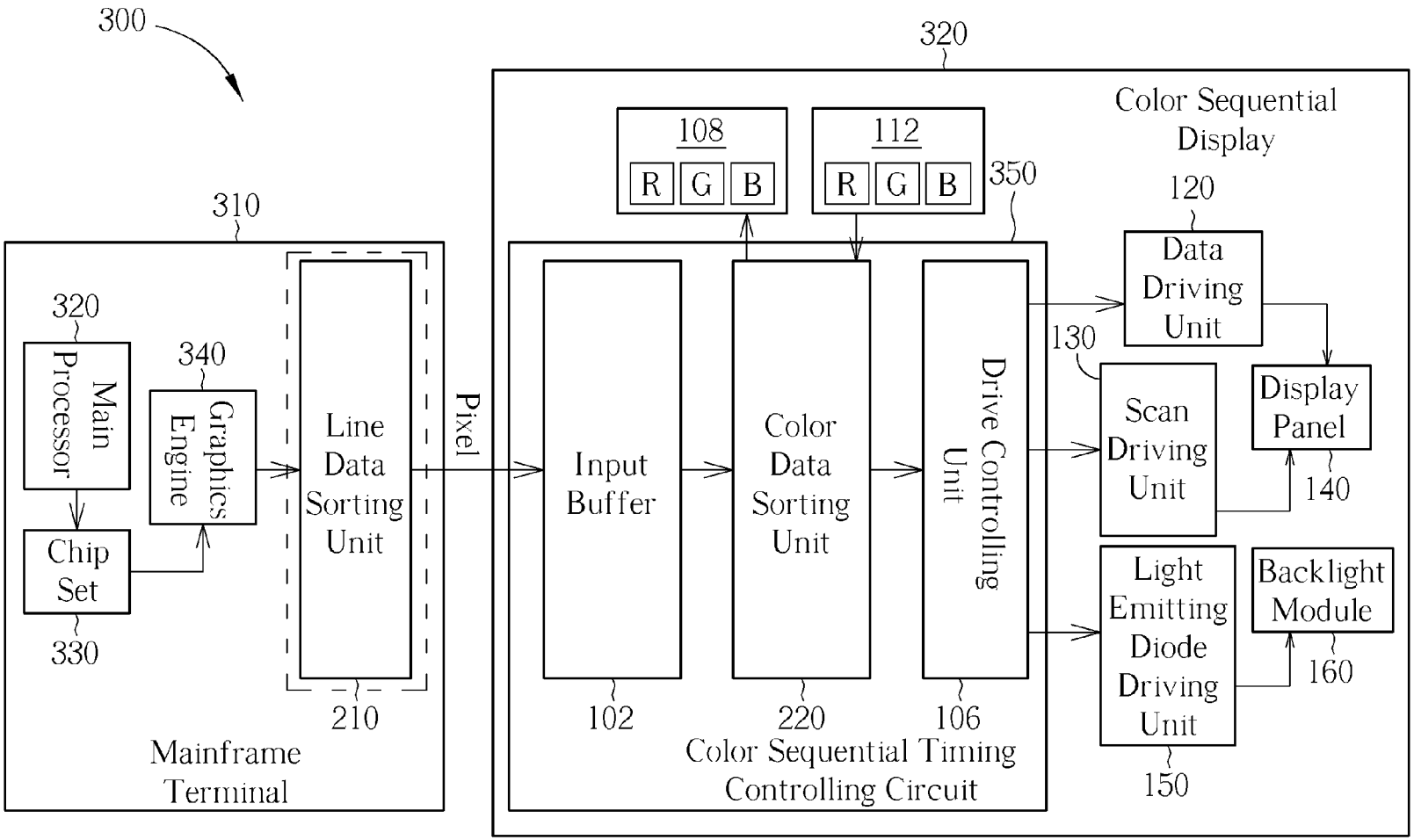
FIG. 5 illustrates a color display system according to a second embodiment of the present invention.

Please refer to FIG. 5, which illustrates a color display system 300 according to a second embodiment of the present invention. The color sequential display system 300 includes a mainframe terminal 310 and a color sequential display 320. The color sequential display 320 includes a color sequential timing controlling circuit 350, the buffers 108 and 112, the data driving unit 120, the scan driving unit 130, the display panel 140, the light emitting diode driving unit 150, and the backlight module 160. The mainframe terminal 310 includes a main processor 320, a chip set 330, a graphics engine 340, and the line data processing unit 210. The main processor 320, the chip set 330, and the graphics engine 340 are used for generating requited pixels of a complete frame, and for inputting the generated pixels into the line data processing unit 210. The second embodiment shown in FIG. 5 primarily differs with the first embodiment shown in FIG. 2 in disposing the line data sorting unit 210 on the mainframe terminal 310, instead of on the color sequential timing controlling circuit 250 as shown in FIG. 2. Therefore, sorting of the pixels are completed before the pixels enter the color sequential timing controlling circuit 350, and the color sequential timing controlling circuit 350 is merely required for classifying sub-pixels of different types and for controlling timings of driving units so as to display the full-color frame precisely according to the color sequential method. Elements shown in FIG. 5 are similar with those in FIG. 2 in composition or function so that related details are not repeatedly described.

Figure 6:
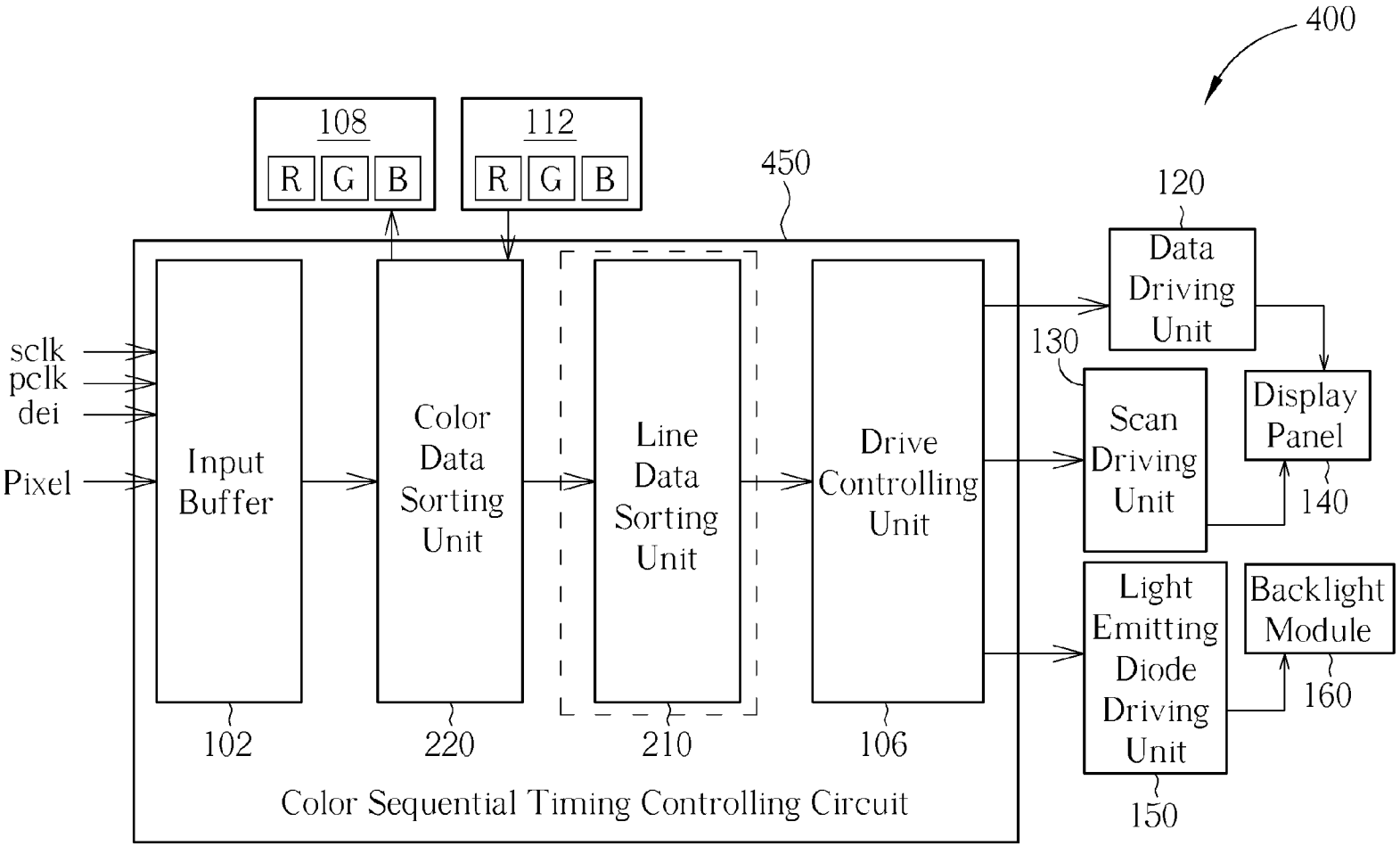
FIG. 6 illustrates a color sequential display according to a third embodiment of the present invention.
Figure 7:
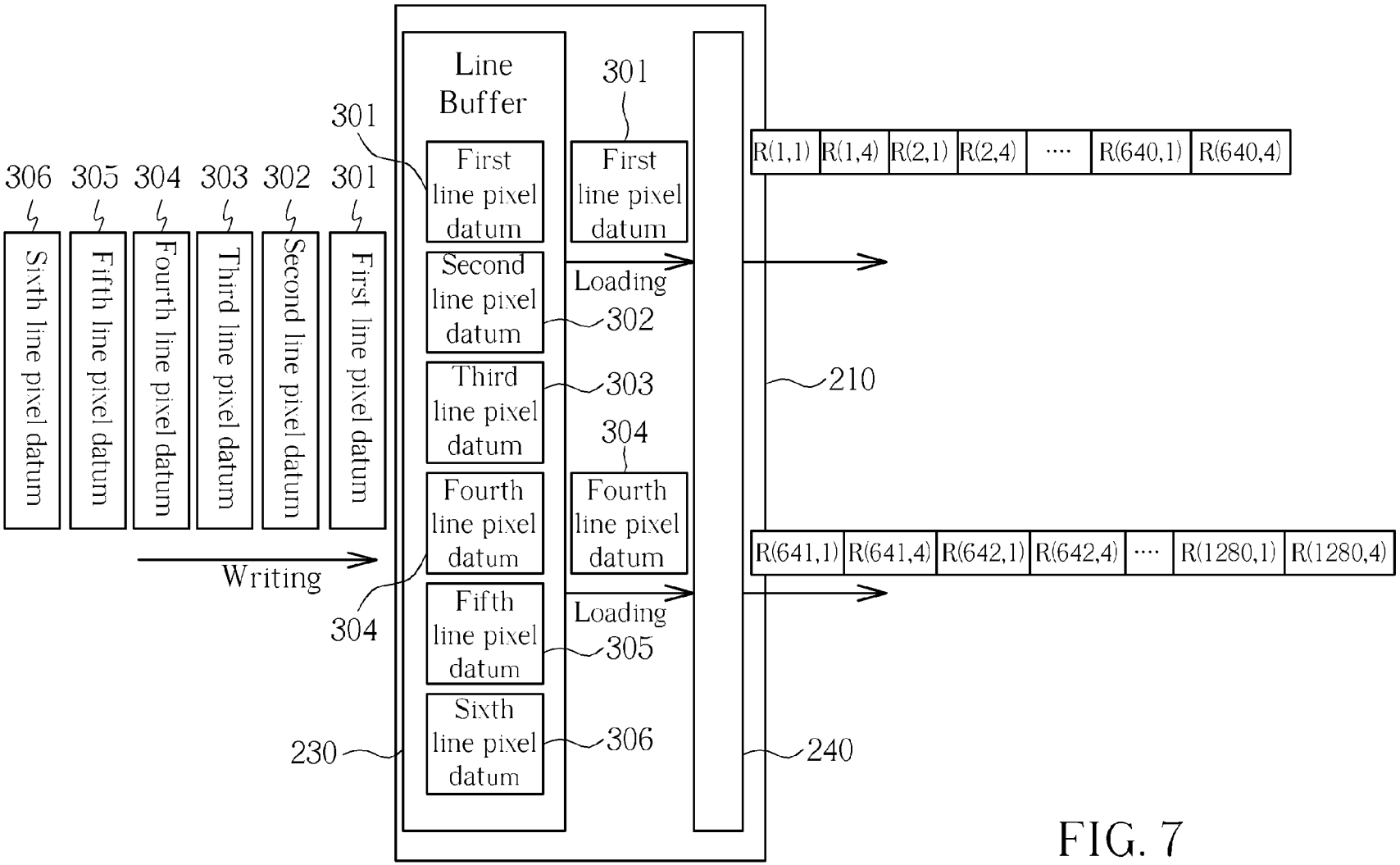
FIG. 7 and FIG. 8 schematically illustrate how to buffer, sort, and output sub-pixels within the line data sorting unit shown in FIG. 6.
Figure 8:
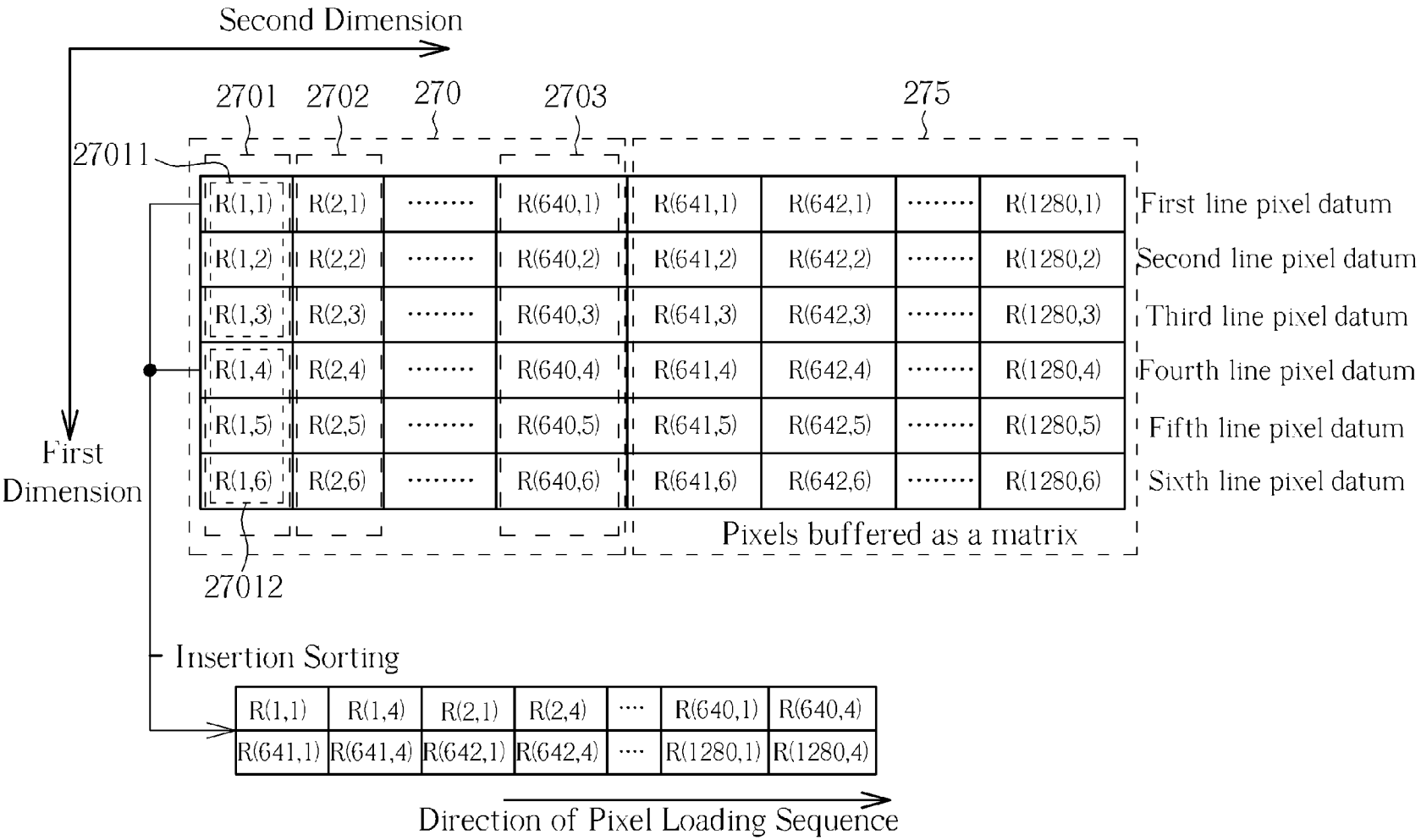

Please refer to FIG. 6, FIG. 7, and FIG. 8. FIG. 6 illustrates a color sequential display 400 according to a third embodiment of the present invention. The color sequential display 400 differs with the color sequential display 200 shown in FIG. 2 in the color sequential timing controlling circuit 450. Pixels outputted by the input buffer 102 are first classified according to colors of sub-pixels by the color data sorting unit 220, so as to generate a plurality of sub-pixel groups, for example, a red sub-pixel group, a green sub-pixel group, and a blue sub-pixel group, and to input the generated sub-pixel groups into the line data sorting unit 210. On the contrary to FIG. 3 and FIG. 4 in receiving line pixel data, in FIG. 6, the line data sorting unit 210 receives the plurality of generated sub-pixel groups, and the received plurality of sub-pixel groups are illustrated as line sub-pixel data in FIG. 7 and FIG. 8.

FIG. 7 and FIG. 8 schematically illustrate how to buffer, sort, and output sub-pixels within the line data sorting unit 210 shown in FIG. 6. The means of buffering, sorting, and outputting sub-pixels in FIG. 7 and FIG. 8 are similar with those in FIG. 3 and FIG. 4, except for processing data in units of sub-pixels, instead of in units of pixels. Therefore, in FIG. 7 and FIG. 8, sub-pixels of a single type are indicated as R(1,1), R(1,2), . . . , R(1,6), R(2,1), R(2,2), . . . , R(2,6), R(3,1), R(3,2), . . . , R(3,6), . . . , R(640,1), R(640,2), . . . , R(640,6), R(641,1), R(641,2), . . . , R(641,6), . . . , R(1280,1), R(1280,2), . . . , R(1280,6), i.e., a plurality of sub-pixels included by a single sub-pixel group. Besides line sub-pixel data inputted to the line data sorting unit 210 are indicated as line sub-pixel data 401, 402, 403, 404, 405, and 406.

Figure 9:
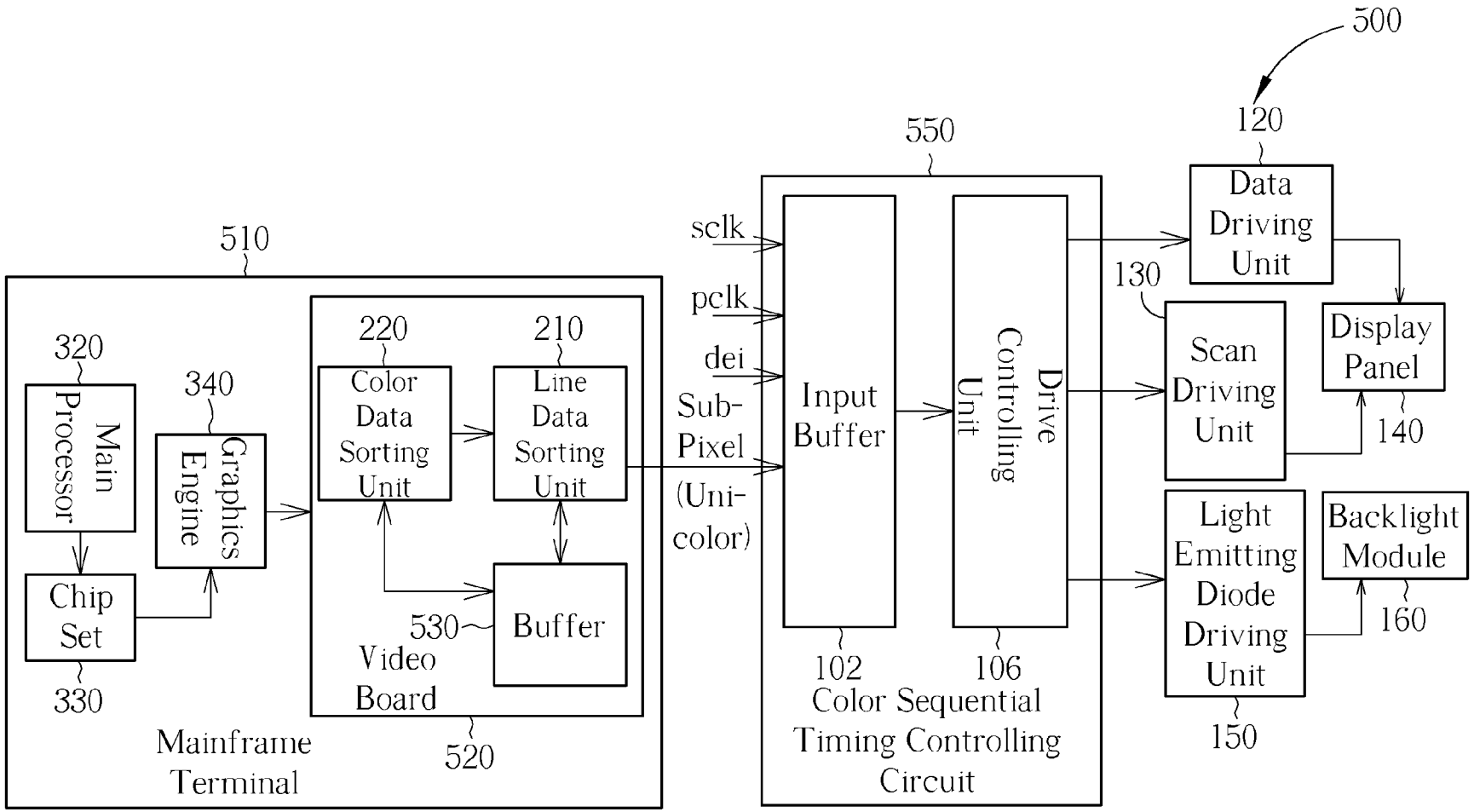
FIG. 9 illustrates a color sequential display according to a fourth embodiment of the present invention.

Please refer to FIG. 9, which illustrates a color sequential display 500 according to a fourth embodiment of the present invention. As shown in FIG. 9, the color sequential display 500 shares a video board 520 and a buffer 530 of the video board 520 with a mainframe terminal 510. Therefore, the procedure of segmenting pixels into sub-pixels of different colors may be directly completed with the aid of the color data sorting unit 220, the line data sorting unit 210, and the buffer 530 of the video board 520, so that a plurality of classified and sorted sub-pixel groups may be directly inputted into a color sequential timing controlling circuit 550 of the color sequential display 500 from the video board 520, and may be perform with required synchronization by the color sequential timing controlling circuit 550. Besides, buffering, sorting, and outputting of sub-pixels by the line data sorting unit 210 by the video board 520 are the same with those shown in FIG. 7 and FIG. 8 so that related details are not repeatedly described.

Figure 10:
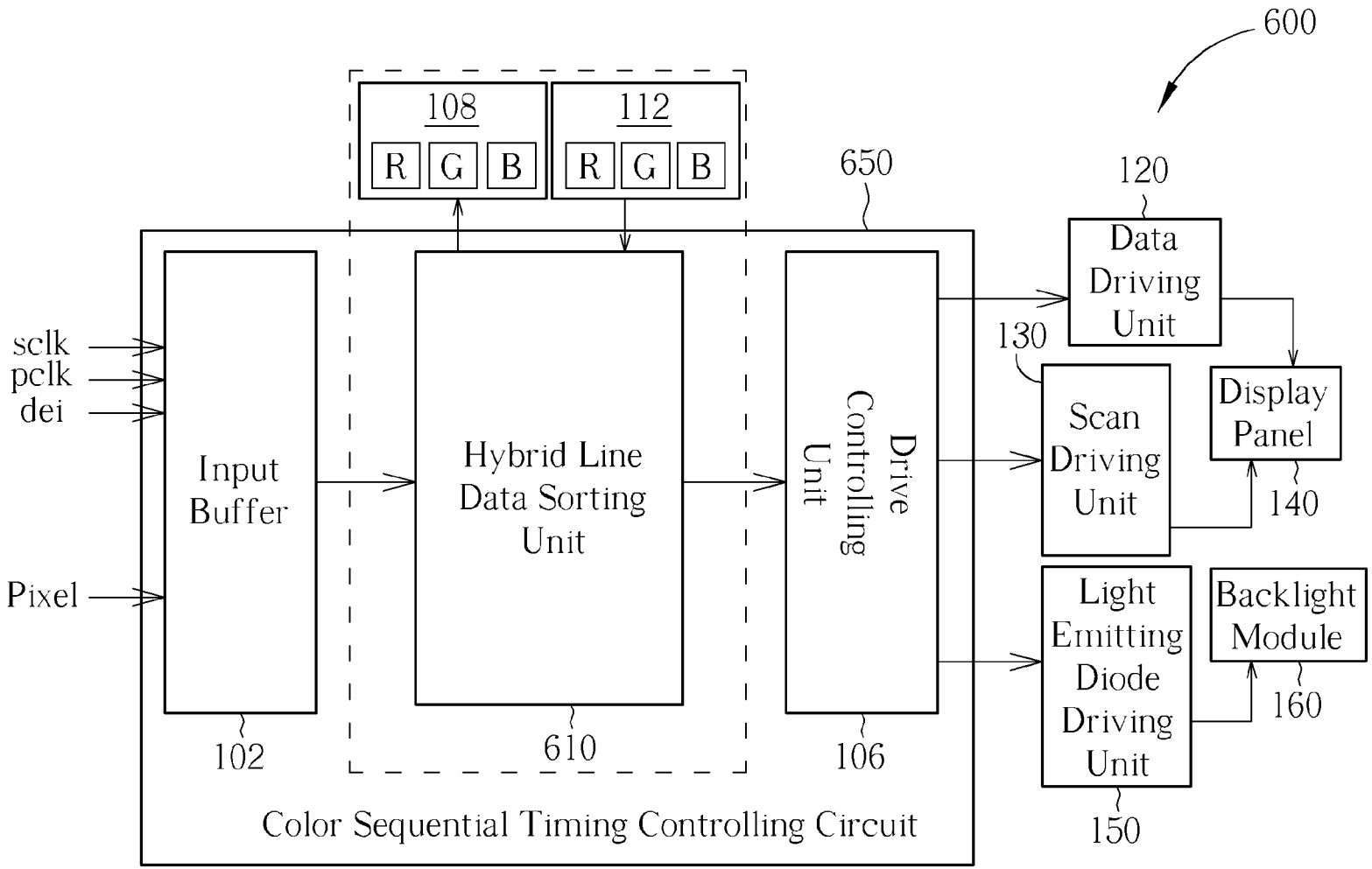
FIG. 10 illustrates a color sequential display according to a fifth embodiment of the present invention.
Figure 11:
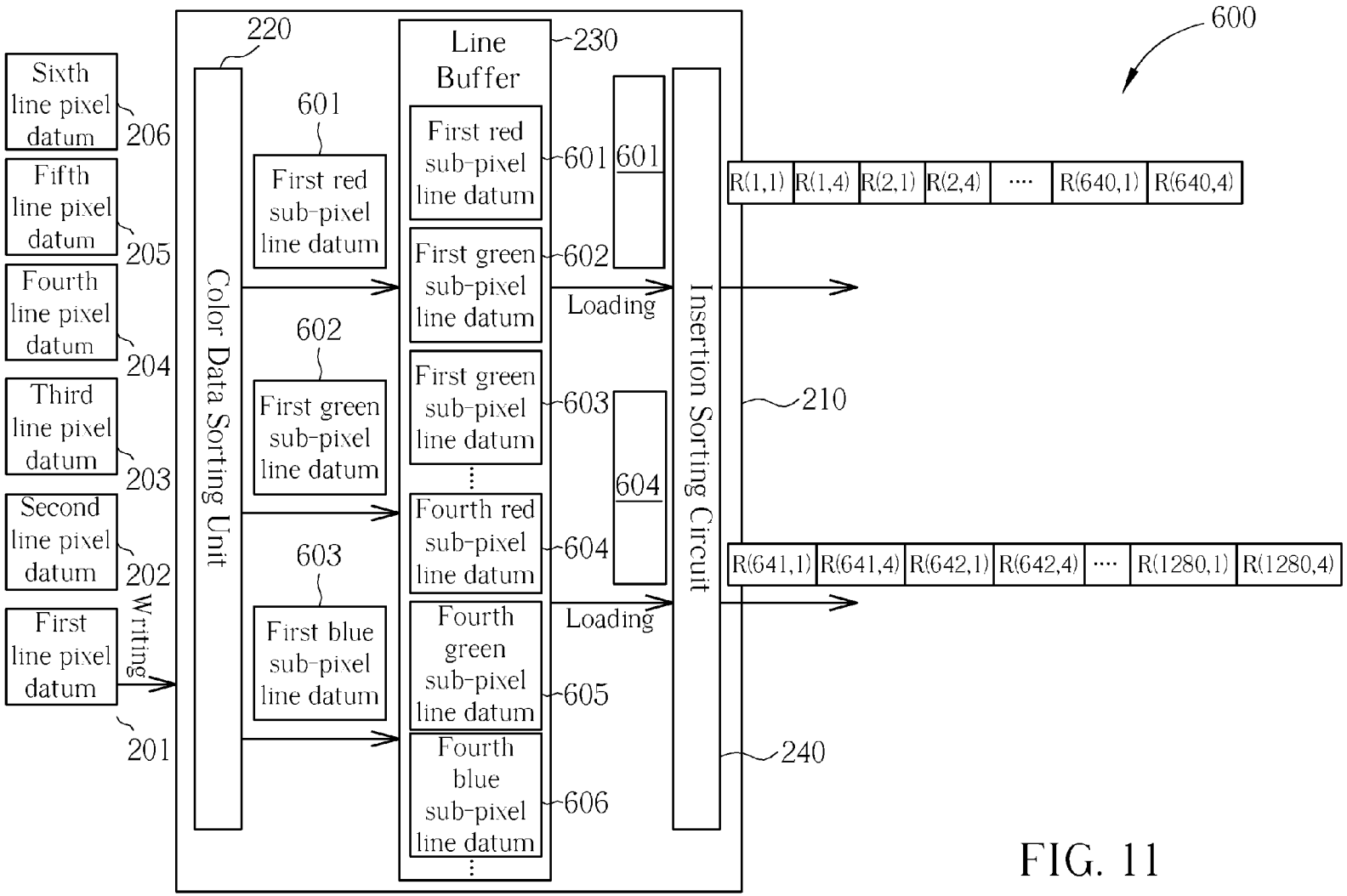
FIG. 11 illustrates the hybrid line data sorting unit shown in FIG. 10.

Please refer to FIG. 10, which illustrates a color sequential display 600 according to a fifth embodiment of the present invention. The color sequential display 600 differs with the fore embodiments in a color sequential timing controlling circuit 650, which includes a hybrid line data sorting unit 610 in replacement of functions of both the line data sorting unit 210 and the color data sorting unit 220 mentioned in the above embodiments. Please refer to FIG. 11, which illustrates the hybrid line data sorting unit 610 shown in FIG. 10. As shown in FIG. 11, the color data sorting unit 220 included by the hybrid line data sorting unit 610 receives a plurality of line pixel data 201, 202, 203, 204, 205, and 206, and segmenting each of the line pixel data 201-206 into a plurality of sub-pixels so as to buffer the plurality of sub-pixels into the line buffer 230. For example, the plurality of sub-pixels shown in FIG. 11 includes a first red line sub-pixel datum 601, a first green line sub-pixel datum 602, a first blue line sub-pixel datum 603, a fourth red line sub-pixel datum 604, a fourth green line sub-pixel datum 605, and a fourth blue line sub-pixel datum 606. FIG. 11 also schematically illustrates how to sort and output sub-pixels of the first red line sub-pixel datum 601 and the fourth red line sub-pixel datum 604 in a similar manner with as shown in FIG. 4 and FIG. 8. Since the procedure of buffering, sorting, and outputting the sub-pixels have been mentioned above, repeated descriptions are saved for brevity.

Figure 12:
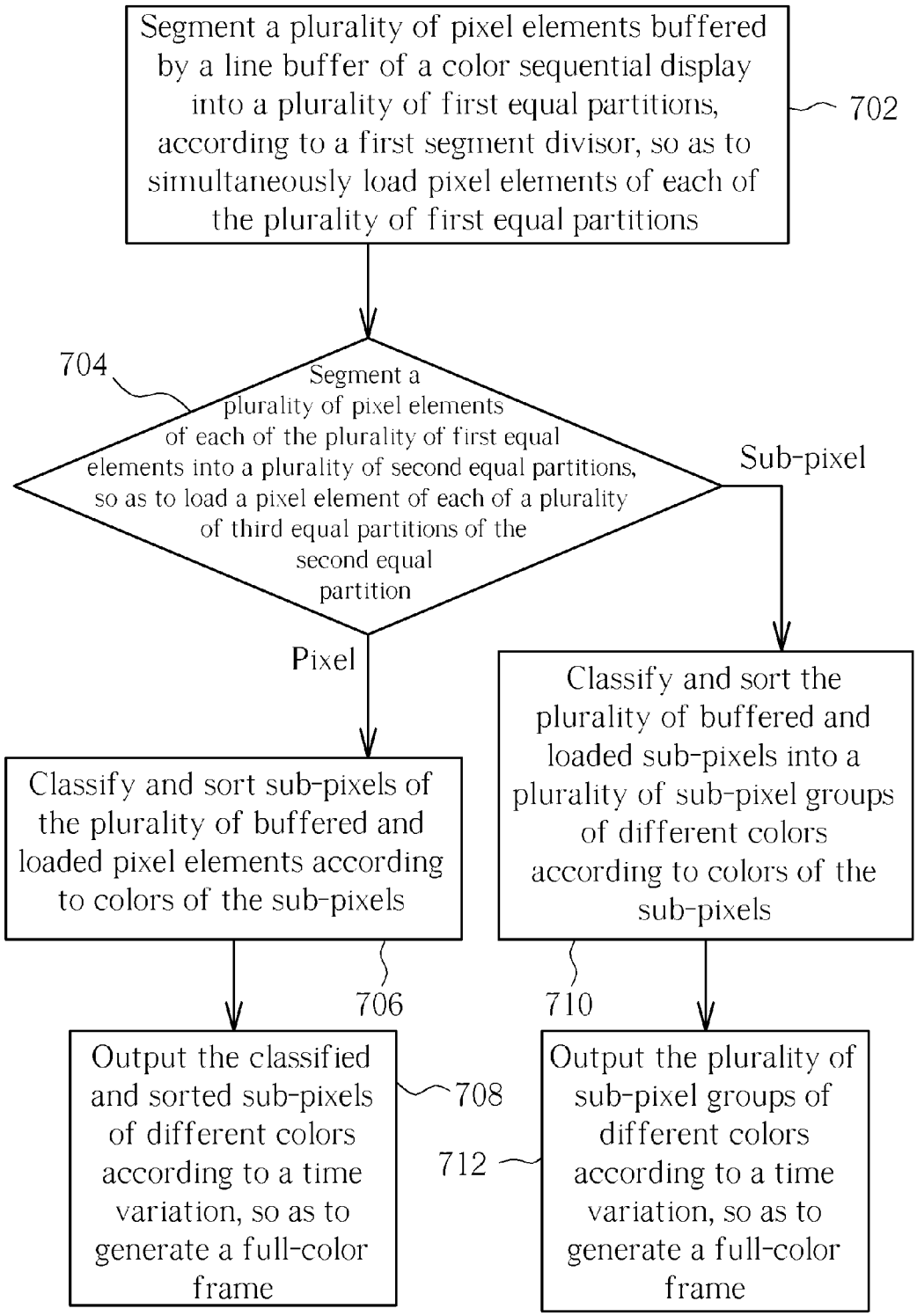
FIG. 12 illustrates the image data sorting and loading method of loading data by activating multi-gate lines in cooperation with data arrangement on a color sequential display, according to the above disclosure about buffering, sorting, and outputting pixels/sub-pixels on the line buffer in the present invention.

Please refer to FIG. 12, which illustrates the image data sorting and loading method of loading data by activating multi-gate lines in cooperation with data arrangement on a color sequential display, according to the above disclosure about buffering, sorting, and outputting pixels/sub-pixels on the line buffer in the present invention. As shown in FIG. 12, the image data sorting and loading method of the present invention includes steps as follows:

Step 702: Segment a plurality of pixel elements buffered by a line buffer of a color sequential display into a plurality of first equal partitions, according to a first segment divisor, so as to simultaneously load pixel elements of each of the plurality of first equal partitions, where pixel elements of each of the first equal partitions are arranged as a matrix on the line buffer;

Step 704: Segment a plurality of pixel elements of each of the plurality of first equal elements into a plurality of second equal partitions, so as to load a pixel element of each of a plurality of third equal partitions of the second equal partition, where a number of the plurality of third equal partitions included by the second equal partition is corresponding to a number of simultaneously activated gate lines of a scan driving unit of the color sequential display; when the pixel element indicates a pixel, go to Step 706; when the pixel element indicates a sub-pixel, go to Step 710;

Step 706: Classify and sort sub-pixels of the plurality of buffered and loaded pixel elements according to colors of the sub-pixels;

Step 708: Output the classified and sorted sub-pixels of different colors according to a time variation, so as to generate a full-color frame;

Step 710: Classify and sort the plurality of buffered and loaded sub-pixels into a plurality of sub-pixel groups of different colors according to colors of the sub-pixels; and Step 712: Output the plurality of sub-pixel groups of different colors according to a time variation, so as to generate a full-color frame.

Steps shown in FIG. 12 indicate a summary in sorting and loading pixels according to the abovementioned embodiments of the present invention. However, embodiments generated by permutations and/or combinations of the steps shown in FIG. 12 or by adding restrictions mentioned above should also be regarded as embodiments of the present invention.

The present invention discloses a color sequential timing controlling circuit and both a color sequential display systems and an image data sorting/loading method thereof. By simultaneously activating multiple gate lines and with the aid of the image data sorting and loading method of the present invention, besides a high data transmission efficiency is fulfilled by activating multiple gate lines at a time, transmission error of pixel data caused by activating multiple gate lines simultaneously may be neutralized. In other words, preciseness in arranging and outputting pixels with at least two simultaneously-activated gate lines can be preserved, with the aid of the color sequential timing controlling circuit and the image data sorting and loading method of the present invention.

Those skilled in the art will readily observe that numerous modifications and alterations of the device and method may be made while retaining the teachings of the invention.

What is claimed is:

1. A color sequential timing controlling circuit, applied on a color sequential display and of activating multi-gate lines in cooperation with data arrangement for loading data, the color sequential timing controlling circuit comprising:

a line data sorting unit, for buffering and loading a plurality of pixels, the line data sorting unit comprising:

a line buffer, for buffering the plurality of pixels in a matrix form; and an insertion sorting circuit, for segmenting the plurality of pixels buffered by the line buffer into a plurality of first equal partitions according to a first segment divisor, so as to simultaneously load pixels of each of the plurality of first equal partitions, and for segmenting each of the first equal partitions into a plurality of second equal partitions according to a second segment divisor, so as to loads pixels in each of the second equal partitions according to a pixel loading sequence; and a color data sorting unit, for classifying and sorting sub-pixels of the plurality of pixels loaded and buffered by the line data sorting unit, according to colors of the sub-pixels;

wherein the color sequential timing controlling circuit outputs the sub-pixels sorted by the color data sorting unit according to a time variation, so as to generate a full-color frame;

wherein the pixel loading sequence indicates simultaneously loading a pixel from each of a plurality of third equal partitions segmented from the second equal partition, and a number of the plurality of third equal partitions in the second equal partition is corresponding to a number of simultaneously activated gate lines of a scan driving unit of the color sequential display.

2. The color sequential timing controlling circuit of claim 1, wherein the line buffer buffers the plurality of pixels in a two-dimensional manner;

wherein a plurality of pixels included by each of the plurality of second equal partitions are aligned on a first dimensional line extended along a first dimension of the line buffer so that a plurality of pixels included by each of the plurality of second equal partitions are stored as elements of the first dimensional line on the line buffer, and the plurality of second equal partitions are aligned along a second dimension on the line buffer;

wherein a size of the first dimensional line equals a number of pixels included by each of the second equal partitions;

wherein a size of the second dimensional line equals a total number of the plurality of second equal partitions on the line buffer.

3. The color sequential timing controlling circuit of claim 2, wherein an amount of the plurality of pixels stored by the line buffer is divisible by the first segment divisor;

wherein an amount of the plurality of pixels included by each of the first equal partitions is divisible by the second segment divisor;

wherein an amount of the plurality of pixels included by each of the second equal partitions is divisible by an amount of the plurality of third equal partitions of each of the second equal partitions.

4. The color sequential timing controlling circuit of claim 1, wherein a first secondary buffer and a second secondary buffer of the color sequential display are used as buffers of the color data sorting unit, and when one of the first and second secondary buffers is used for loading a first group of sub-pixels sorted by the color data sorting unit, the other one of the first and second secondary buffers is used for writing a second group of sub-pixels sorted by the color data sorting unit.

5. The color sequential timing controlling circuit of claim 1, further comprising:

an input buffer, for synchronizing a synchronous signal, which is inputted from external of the color sequential timing controlling circuit, a pixel clock, the plurality of pixels, and a system clock used by the color sequential timing controlling circuit, and for inputting the plurality of pixels into the line data sorting unit; and a drive controlling unit, for generating timings for controlling a data driving unit, a scan driving unit according to the synchronous signal and the system clock, and a light emitting diode driving circuit included by the color sequential display, and for controlling the data driving unit and the scan driving unit to display the full-color frame on a display panel included by the color sequential display, according to the sub-pixels of different colors outputted by the color sequential timing controlling circuit.

6. A color sequential display system, comprising:

a line data sorting unit, included by a mainframe terminal of the color sequential display system, for buffering and loading a plurality of pixels, the line data sorting unit comprising:

a line buffer, for buffering the plurality of pixels;

an insertion sorting circuit, for segmenting the plurality of pixels buffered by the line buffer into a plurality of first equal partitions, for simultaneously loading arranged-in-matrix pixels of each of the plurality of first equal partitions, and for segmenting a plurality of pixels of each of the plurality of first equal partitions into a plurality of second equal partitions according to a second segment divisor, for loading pixels from each of the plurality of second equal partitions according to a pixel loading sequence; and a color data sorting unit, included by a color sequential display of the color sequential display system, for classifying and sorting sub-pixels of each of the plurality of pixels, according to colors of the sub-pixels buffered and loaded by the line data sorting unit;

wherein the color sequential display outputs the sub-pixels of different colors classified by the color data sorting unit according to a time variation, so as to generate a full-color frame;

wherein the pixel loading sequence indicates simultaneously loading a pixel of each of a plurality of third equal partitions included by the second equal partition, and a number of the plurality of third equal partitions is corresponding to a number of simultaneously activated gate lines of a scan driving unit of the color sequential display.

7. The color sequential display system of claim 6, wherein the line buffer buffers the plurality of pixels in a two-dimensional manner;

wherein a plurality of pixels of each of the plurality of second equal partitions are arranged on a first dimensional line extended along a first dimension of the line buffer, so that a plurality of each of the second equal partition are stored in the line buffer as elements of the first dimensional line, and the plurality of second equal partitions on the line buffer are arranged along a second dimension of the line buffer;

wherein a size of the first dimensional line equals a number of each of the plurality of second equal partitions;

wherein a size of the second dimensional line equals to a total number of the plurality of second partitions on the line buffer.

8. The color sequential display system of claim 6, wherein a number of the plurality of pixels buffered on the line buffer is divisible for the first segment divisor;

wherein a number of the plurality of pixels included by each of the plurality of first equal partitions is divisible for the second segment divisor;

wherein a number of pixels included by each of the plurality of second equal partitions is divisible by a number of the plurality of third equal partitions included by each of the plurality of second equal partitions.

9. The color sequential display system of claim 6 further comprising:

a first secondary buffer; and a second secondary buffer;

wherein both the first and second secondary buffers are used as buffers of the color data sorting unit, and when one of the first and second secondary buffers loads a first group of sub-pixels sorted by the color data sorting unit, the other one of the first and second secondary buffers writes a second group of sub-pixels sorted by the color data sorting unit.

10. The color sequential display system of claim 6 further comprising:

an input buffer, for receiving the plurality of pixels buffered and loaded by the line data sorting unit, synchronizing a synchronous signal inputted from external of the color sequential display, a pixel clock, the plurality of pixels, and a system clock used by the color sequential display, and for inputting the plurality of pixels into the color data sorting unit; and a drive controlling unit, for generating timings of a data driving unit, a scan driving unit, and a light emitting diode driving circuit included by the color sequential display according to the synchronous signal and the system clock, and for controlling both the data driving unit and the scan driving unit to display a generated full-color frame on a display panel of the color sequential display according to the sub-pixels of different colors outputted by the color sequential timing controlling circuit.

11. A color sequential timing controlling circuit, applied on a color sequential display and of activating multi-gate lines in cooperation with data arrangement for loading data, the color sequential timing controlling circuit comprising:

a color data sorting unit, for classifying and sorting sub-pixels of a plurality of pixels into a plurality of sub-pixel groups, each of which corresponds to different colors, according to colors of the sub-pixels; and a line data sorting unit, for buffering and loading the plurality of sub-pixel groups from the color data sorting unit, the line data sorting unit comprising:

a line buffer, for buffering one of the plurality of sub-pixel groups; and an insertion sorting circuit, for segmenting a plurality of sub-pixels included by the sub-pixel group buffered by the line buffer into a plurality of first equal partitions, according to a first segment divisor, so as to simultaneously load arranged-in-matrix sub-pixels of each of the plurality of first equal partitions, the insertion sorting circuit being for segmenting a plurality of sub-pixels of each of the plurality of first equal partitions into a plurality of second equal partitions according to a second segment divisor, so as to load sub-pixels of each of the second equal partitions according to a sub-pixel loading sequence;

wherein the color sequential display outputs a plurality of sub-pixel groups of different colors loaded by the line data sorting unit according to a time variation, for generating a full-color frame;

wherein the sub-pixel loading sequence indicates simultaneously loading a sub-pixel of each of the plurality of third equal partitions, and a number of the plurality of third equal partitions corresponds to a number of simultaneously activated gate lines of a scan driving unit included by the color sequential display.

12. The color sequential timing controlling circuit of claim 11, wherein the line buffer buffers a plurality of sub-pixels included by the sub-pixel group in a two-dimensional manner;

wherein a plurality of sub-pixels of each of the plurality of second equal partitions are arranged on a first dimensional line extended along a first dimension of the line buffer, so that a plurality of sub-pixels of each of the plurality of second equal partition are stored as a plurality of elements of the first dimensional line on the line buffer, and the plurality of second equal partitions included by the line buffer are arranged along a second dimension of the line buffer;

wherein a size of the first dimensional line equals to a number of sub-pixels included by each of the plurality of second partitions;

wherein a size of the second dimensional line equals to a total number of the plurality of second partitions on the line buffer.

13. The color sequential timing controlling circuit of claim 11, wherein a number of the plurality of sub-pixels buffered in the line buffer is divisible by the first segment divisor;

wherein a number of a plurality of sub-pixels included by each of the plurality of first equal partitions is divisible by the second segment divisor;

wherein a number of sub-pixels of each of the plurality of second equal partitions is divisible by a number of the plurality of third equal partitions in each of the plurality of second equal partitions.

14. The color sequence timing controller of claim 11, wherein the color sequential display comprises a first secondary buffer and a second secondary buffer used as buffers of the color data sorting unit, and when one of the first and second secondary buffers is used for loading a first group of sub-pixels sorted by the color data sorting unit, the other one of the first and second secondary buffers is used for writing a second group of sub-pixels sorted by the color data sorting unit.

15. The color sequential timing controlling circuit of claim 11 further comprising:

an input buffer, for synchronizing a synchronous signal, which is inputted from external of the color sequential timing controlling circuit, a pixel clock, the plurality of pixels, and a system clock used by the color sequential timing controlling circuit, and inputting the plurality of pixels into the line data sorting unit; and a drive controlling unit, for generating timings of controlling a data driving unit, a scan driving unit, and a light emitting diode driving circuit included by the color sequential display, according to the synchronous signal and the system clock, and for controlling the data driving unit and the scan driving unit to display the generated full-color frame, according to the sub-pixel groups of different colors outputted by the line sorting unit.

16. A color sequential timing controlling circuit, applied on a color sequential display and of activating multi-gate lines in cooperation with data arrangement for loading data, the color sequential timing controlling circuit comprising:

a line buffer, for buffering one of the plurality of sub-pixel groups of different colors; and an insertion sorting circuit, for segmenting a plurality of sub-pixels included by the sub-pixel group buffered by the line buffer into a plurality of first equal partition according to a first segment divisor, for simultaneously loading arranged-in-matrix sub-pixels of the plurality of first equal partitions, and the insertion sorting circuit being used for segmenting a plurality of sub-pixels included by each of the plurality of first equal partitions into a plurality of second equal partitions, so as to load sub-pixels in each of the plurality of second equal partitions according to a sub-pixel loading sequence;

wherein the color sequence timing controller shares a video board and a buffer of the video board with a mainframe terminal, and the plurality of sub-pixel groups are generated by classifying and sorting sub-pixels of a plurality of pixels by the video board and the buffer;

wherein the color sequential display outputs a plurality of sub-pixel groups of different colors loaded by the line data sorting unit according to a time variation, so as to generate a full-color frame;

wherein the sub-pixel loading sequence indicates simultaneously loading a sub-pixel from each of a plurality of third equal partitions included by the second equal partition, and a number of the plurality of third equal partitions in the second equal partition is corresponding to a number of simultaneously activated gate lines of a scan driving unit of the color sequential display.

17. The color sequential timing controlling circuit of claim 16, wherein the line buffer buffers a plurality of sub-pixels of the sub-pixel group in a two-dimensional manner;

wherein a plurality of sub-pixels of each of the plurality of second equal partitions are arranged on a first dimensional line along a first dimension of the line buffer, so that a plurality of sub-pixels of each of the plurality of second equal partitions are stored as elements of the first dimensional line on the line buffer, and the plurality of second equal partitions of the line buffer are aligned along a second dimension of the line buffer;

wherein a size of the first dimensional line equals a number of sub-pixels of each of the plurality of second equal partitions;

wherein a size of the second dimensional line equals a total number of the plurality of second equal partitions in the line buffer.

18. The color sequential timing controlling circuit of claim 16, wherein a number of the plurality of sub-pixels buffered by the line buffer is divisible by the first segment divisor;

wherein a number of a plurality of sub-pixels included by each of the first equal partitions is divisible by the second segment divisor;

wherein a number of sub-pixels included by each of the plurality of second equal partitions is divisible by a number of the plurality of third equal partitions included by each of the second equal partitions.

19. The color sequential timing controlling circuit of claim 16 further comprising:

an input buffer, for synchronizing a synchronous signal, which is inputted external to the color sequential timing controlling circuit, a pixel clock, the plurality of pixels, and a system clock used by the color sequential timing controlling circuit, and for inputting the plurality of pixels into the line buffer; and a drive controlling unit, for generating timings of a data driving unit, a scan driving unit, and a light emitting diode driving circuit included by the color sequential display according to the synchronous signal and the system clock, and for controlling the data driving unit and the scan driving unit to display the generated full-color frame on a display panel included by the color sequential display, according to the sub-pixel groups of different colors outputted by the line data sorting unit.

20. A color sequential timing controlling circuit, applied on a color sequential display and of activating multi-gate lines in cooperation with data arrangement for loading data, the color sequential timing controlling circuit comprising:

a hybrid line data sorting unit, for buffering a plurality of pixels, and for loading the plurality of pixels in forms of sub-pixels, the hybrid line data sorting unit comprising:

a color data sorting unit, for classifying and sorting sub-pixels of each of the plurality of pixels into a plurality of sub-pixel groups, according to colors of the sub-pixels of each of the plurality of pixels, each of the plurality of sub-pixel groups being corresponding to an unique color;

a line buffer, for buffering the plurality of sub-pixel groups in forms of matrixes; and an insertion circuit, for segmenting a plurality of sub-pixels included by one of the plurality of sub-pixel groups into a plurality of first equal partitions, according to a first segment divisor, so as to simultaneously load arranged-in-matrix sub-pixels of each of the plurality of first equal partitions, and for segmenting a plurality of sub-pixels of each of the plurality of first equal partitions, according to a second segment divisor, so as to load sub-pixels in each of the plurality of second equal partitions according to a sub-pixel loading sequence;

wherein the color sequential timing controlling circuit outputs a plurality of sub-pixel groups of different colors sorted by the color data sorting unit according to a time variation, so as to generate a full-color frame;

wherein the sub-pixel loading sequence indicates simultaneously loading a sub-pixel from each of the plurality of third equal partitions included by the second equal partition, and a number of the plurality of third equal partitions is corresponding to a number of simultaneously activated gate lines of a scan driving unit included by the color sequential display.

21. The color sequential timing controlling circuit of claim 20, wherein the line buffer buffers the plurality of sub-pixel groups in a two-dimensional manner;

wherein a plurality of sub-pixels included by each of the plurality of second equal partitions are aligned on a first dimensional line extended along a first dimension of the line buffer so that a plurality of sub-pixels included by each of the plurality of second equal partitions are stored as elements of the first dimensional line on the line buffer, and the plurality of second equal partitions are aligned along a second dimension on the line buffer;

wherein a size of the first dimensional line equals a number of sub-pixels included by each of the second equal partitions;

wherein a size of the second dimensional line equals a total number of the plurality of second equal partitions on the line buffer.

22. The color sequential timing controlling circuit of claim 21, wherein an amount of the plurality of sub-pixels stored by the line buffer is divisible by the first segment divisor;

wherein an amount of the plurality of sub-pixels included by each of the first equal partitions is divisible by the second segment divisor;

wherein an amount of the plurality of sub-pixels included by each of the second equal partitions is divisible by an amount of the plurality of third equal partitions within each of the second equal partitions.

23. The color sequential timing controlling circuit of claim 20, wherein a first secondary buffer and a second secondary buffer of the color sequential display are used as buffers of the hybrid line data sorting unit, and when one of the first and second secondary buffers is used for loading a first group of sub-pixels sorted by the hybrid line data sorting unit, the other one of the first and second secondary buffers is used for writing a second group of sub-pixels sorted by the hybrid line data sorting unit.

24. The color sequential timing controlling circuit of claim 20, further comprising:

an input buffer, for synchronizing a synchronous signal, which is inputted from external of the color sequential timing controlling circuit, a pixel clock, the plurality of pixels, and a system clock used by the color sequential timing controlling circuit, and for inputting the plurality of pixels into the line data sorting unit; and a drive controlling unit, for generating timings for controlling a data driving unit, a scan driving unit according to the synchronous signal and the system clock, and a light emitting diode driving circuit included by the color sequential display, and for controlling the data driving unit and the scan driving unit to display the full-color frame on a display panel included by the color sequential display, according to the sub-pixels groups of different colors outputted by the color sequential timing controlling circuit.

25. An image data sorting and loading method of loading data by activating multi-gate lines in cooperation with data arrangement on a color sequential display, comprising:

segmenting a plurality of pixel elements buffered in a line buffer of a color sequential display into a plurality of first equal partitions according to a first segment divisor, so as to simultaneously load pixel elements of each of the plurality of first equal partitions, wherein pixel elements of each of the plurality of first equal partitions are arranged on the line buffer as a matrix; and segmenting a plurality of pixel elements of each of the plurality of first equal partitions into a plurality of second equal partitions according to a second segment divisor, so as to simultaneously load a pixel element from each of a plurality of third equal partitions within the second equal partition;

wherein a number of the plurality of third equal partitions included by the second equal partition is corresponding to a number of simultaneously activated gate lines of a scan driving unit included by the color sequential display.

26. The method of claim 25, wherein the line buffer buffers the plurality of pixel elements in a two-dimensional manner;

wherein a plurality of pixel elements included by each of the plurality of second equal partitions are aligned on a first dimensional line extended along a first dimension of the line buffer so that a plurality of pixel elements included by each of the plurality of second equal partitions are stored as elements of the first dimensional line on the line buffer, and the plurality of second equal partitions are aligned along a second dimension on the line buffer;

wherein a size of the first dimensional line equals a number of pixel elements included by each of the second equal partitions;

wherein a size of the second dimensional line equals a total number of the plurality of second equal partitions on the line buffer.

27. The method of claim 26, wherein an amount of the plurality of pixel elements stored by the line buffer is divisible by the first segment divisor;

wherein an amount of the plurality of pixel elements included by each of the first equal partitions is divisible by the second segment divisor;

wherein an amount of the plurality of pixel elements included by each of the second equal partitions is divisible by an amount of the plurality of third equal partitions within each of the second equal partitions.

28. The method of claim 26, wherein the pixel element indicates a pixel.

29. The method of claim 28, further comprising:

classifying and sorting sub-pixels of each of the plurality of pixel elements according to colors of the sub-pixels; and outputting a plurality of classified and sorted sub-pixels of different colors according to a time variation, so as to generate a full-color frame.

30. The method of claim 26, wherein the pixel element indicates a sub-pixel.

31. The method of claim 30 further comprising:

classifying and sorting sub-pixels of each of the plurality of pixel elements into a plurality of sub-pixel groups corresponding to colors, according to colors of the sub-pixels of each of the plurality of pixel elements; and outputting the plurality of sub-pixel groups of different colors according to a time variation, so as to generate a full-color frame.

32. A color sequential display system of loading data by activating multi-gate lines in cooperation with data arrangement, comprising:

a mainframe terminal, comprising:

a video board, comprising:

a color sequential data sorting unit, for classifying and sorting sub-pixels of each of a plurality of pixels, according to colors of the sub-pixels;

a line data sorting unit, for buffering and loading the plurality of pixels classified and sorted by the color data sorting unit, the line data sorting unit comprising:

a line buffer, for buffering the plurality of pixels; and an insertion sorting circuit, for segmenting the plurality of pixels buffered by the line buffer into a plurality of first equal partitions according to a first segment divisor, so as to simultaneously load arranged-in-matrix pixels of each of the plurality of first equal partitions, and for segmenting a plurality of pixels of each of the plurality of first equal partitions into a plurality of second equal partitions according to a second segment divisor, so as to load pixels from each of the plurality of second equal partitions according to a pixel loading sequence; and a buffer, for serving as a buffering unit while classifying and sorting the plurality of pixels by the color data sorting unit and the line data sorting unit; and a color sequential display, comprising:

an input buffer, for receiving the plurality of pixels buffered and loaded by the line data sorting unit, and for synchronizing a synchronous signal, which is inputted from external of the color sequential display, a pixel clock, the plurality of pixels, and a system clock used by the color sequential display; and a drive controlling unit, for controlling timings of a data driving unit, a scan driving unit, and a light emitting diode included by the color sequential display, according to the synchronous signal and the system clock, and for controlling the data driving unit and the scan driving unit to display a generated full-color frame on a display panel of the color sequential display, according to the sub-pixels of different colors outputted by the color sequential timing controlling circuit;

wherein the color sequential display is used for outputting a plurality of sub-pixels of different colors classified and sorted by the color data sorting unit according to a time variation, so as to generate the full-color frame;

wherein the pixel loading sequence indicates simultaneously loading a pixel of each of the plurality of third equal partitions included by the second equal partition, and a number of the plurality of third equal partitions corresponds to a number of simultaneously activated gate lines of a scan driving unit included by the color sequential display;

wherein the color sequential display shares the video board and the buffer with the mainframe terminal.

33. The color sequential display system of claim 32, wherein the line buffer buffers the plurality of pixels in a two-dimensional manner;

wherein a plurality of pixels included by each of the plurality of second equal partitions are aligned on a first dimensional line extended along a first dimension of the line buffer so that a plurality of pixels included by each of the plurality of second equal partitions are stored as elements of the first dimensional line on the line buffer, and the plurality of second equal partitions are aligned along a second dimension on the line buffer;

wherein a size of the first dimensional line equals a number of pixels included by each of the second equal partitions;

wherein a size of the second dimensional line equals a total number of the plurality of second equal partitions on the line buffer.

34. The color sequential display system of claim 32, wherein an amount of the plurality of pixels stored by the line buffer is divisible by the first segment divisor;

wherein an amount of the plurality of pixels included by each of the first equal partitions is divisible by the second segment divisor;

wherein an amount of the plurality of pixels included by each of the second equal partitions is divisible by an amount of the plurality of third equal partitions within each of the second equal partitions.

* * * * *